United States Patent [19]

Baumann

[11] 4,390,045

[45] Jun. 28, 1983

[54] HEDDLE FRAME STAVE

[75] Inventor: Hans Baumann, Horgen, Switzerland

[73] Assignee: Grob & Co. Aktiengesellschaft, Horgen, Switzerland

[21] Appl. No.: 184,783

[22] Filed: Sep. 8, 1980

[30] Foreign Application Priority Data

Sep. 26, 1979 [CH] Switzerland ..... 8671/79

[51] Int. Cl.[3] ..... D03D 9/00

[52] U.S. Cl. ..... 139/91

[58] Field of Search ..... 139/91, 92

[56] References Cited

U.S. PATENT DOCUMENTS 2,674,274 4/1954 Blickenstorfer ..... 139/92

3,754,577 8/1973 Heller ..... 139/92

*Primary Examiner*—Henry Jaudon

*Attorney, Agent, or Firm*—Watson, Cole, Grindle & Watson

[57] ABSTRACT

A heddle frame stave for heddle frames includes a light metal hollow construction having, at least on one side wall, and preferably on opposing side walls, a flat groove-shaped recess. A flat steel strip is adhesively secured in the recess, the strip having a thickness of less than half the side wall thickness and covering preferably at least 60% of the surface of the side wall of the hollow stave. Vibration dampening of the heddle frame stave is thereby achieved, so that the sound produced due to vibrations and the noise development associated therewith, will be reduced considerably especially for fast running weaving machines.

6 Claims, 3 Drawing Figures

HEDDLE FRAME STAVE

BACKGROUND

1. Field of the Invention

This invention relates to heddle frame staves, and more particularly to metallic staves of hollow construction with at least one additional member connected thereto for dampening vibrations and thereby being comparable to staves made of material having different characteristics.

2. Prior Art

In known weaving machines the heddle frame staves are of hollow metal construction to reduce weight and to achieve the highest possible bending stiffness. Light metal, hollow heddle frame staves of lightweight construction have therefore been used, but not without presenting drawbacks.

For example, such frame staves are known to emit bending vibrations which generate sound vibrations which, due to their resonance characteristics, transmit a substantial degree of sound, particularly with fast running weaving machines.

In order to minimize these unpleasant noise developments with heddle frames, vibration-dampening material has been inserted into the hollow profile of the frame staves for filling at least a part of the hollow insides thereof, such material, and which are pressing against the inner side walls of the hollow staves. This insert material will therefore dampen the aforementioned vibrations.

A known frame stave of such construction has round openings on one of its side walls into to which an insert of elastic material is pressed, the insert being in, which slightly larger than the opening so that after insertion it will expand. And, both side walls of the hollow profile stave may have opposed openings into which such an insert is placed so as to sightly protrude outwardly for serving as a guide, for example.

In another construction of a heddle frame stave, the vibration problem is solved in such a way that the distance between the side walls of the hollow profile is smaller than the thickness of the material of the insert, which will be introduced from the face side, such that the side walls will be kept in an elastically deformed shape which minimizes the development of vibrations. The expense of such measures which have been taken, however, rarely justify to the desired results.

In yet another known construction, the heddle frame stave is not hollow, but comprises a solid rail of metal having at least one recess opening outwardly and extending in the longitudinal direction of the frame stave, the recess being filled with a suitable formed body of vibration-dampening material which lies freely to the outside. The combining of the heddle frame and the dampening body can preferably be carried out by glueing. With a profile rail of double T cross-section, the known heddle frame stave has at both sides of the rail a free space between the flanges to be filled with a material which dampens the vibrations, the material preferably being of wood or synthetic material, which therefore form parts of the outside surfaces of the heddle frame stave but do not, however, provide much resistant against wear. Upon impacting the frame staves of adjacent weaving frames during the weaving process resulting in frictional wear, the stressed staves will deteriorate after a rather short time, thereby requiring additional measures, such as guides, to prevent further wear.

Another disadvantage is that with a solid profiled rail having vibration-dampening materials (which may be wood) arranged on both sides of the rail to provide a solid profile, the advantage of a lightweight hollow profile is lost. Furthermore, this type of heddle frame stave is weak against torsional stress.

SUMMARY OF THE INVENTION

An object of the invention is therefore to improve upon heddle frame staves of lightweight construction since the working speed of the weaving machines constantly increases with advanced technical development and therefore a lightweight construction is essential, and so with an increase in working speed of the weaving machine an increased development of noise is produced which must be counter-acted but which, however, is not an easy task to solve in the weaving mills. The objective is therefore to solve this problem using simple measures in an economical manner.

A considerable reduction of noise of several decibels can be achieved with a heddle frame stave of the present construction in such a way that a light metal hollow profile stave with a closed cross-section with flat side walls has at least on one side a glued-on metal band with a material thickness of at least less than half of the wall thickness of the side wall. This glued-on metal band covers preferably at least 60% of the surface on the side wall of the hollow profile stave. In a preferred embodiment the light metal hollow profile stave is formed on both side walls, which are parallel to each other, with a glued-on metal band attached within a recess in each of the side walls.

For an accurate and appropriate mounting of the metal band on the hollow profile stave which can be several meters long, on one or both of the side walls a groove-formed cavity or recess which extends longitudinally and the width of which corresponds to the width of the metal band, may be formed. The metal band is preferably placed into this cavity and is glued with a visco-elastical glue onto the side wall of the hollow profile stave. Preferably this metal band is made of steel.

BRIEF DESCRIPTION OF THE DRAWINGS

The above objects, features and advantages of the invention will be apparent from the following description taken in conjunction with the following drawings wherein.

DETAILED DESCRIPTION

Figure 1:
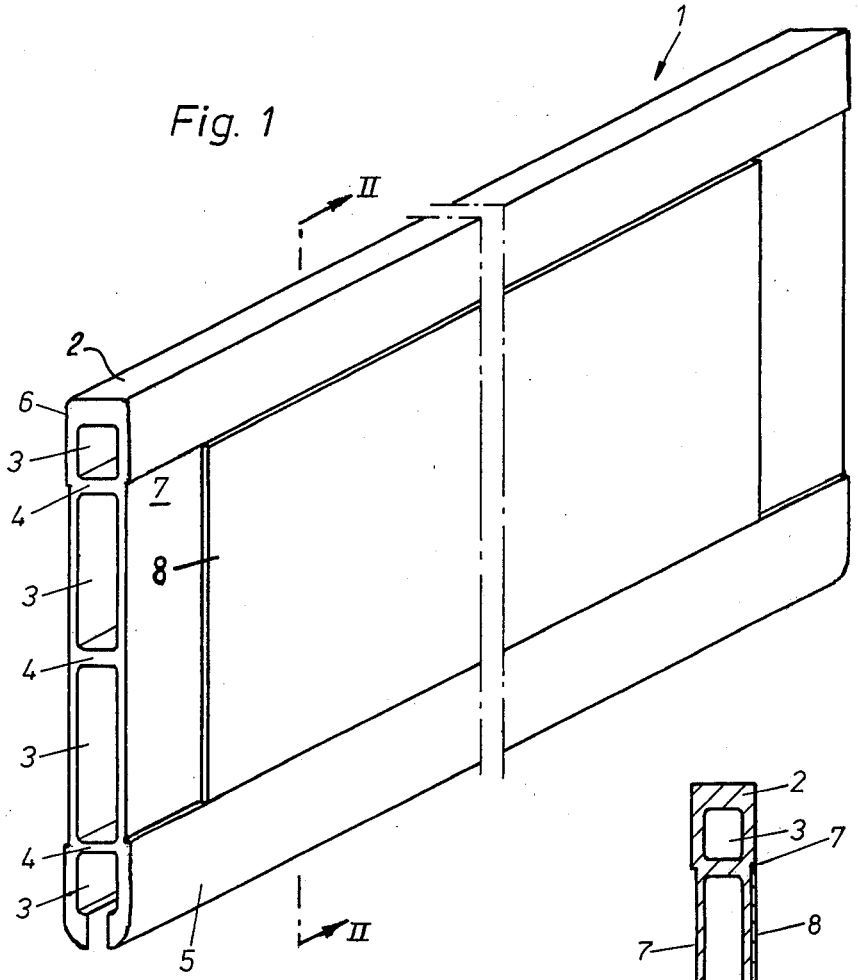
FIG. 1 is a perspective illustration of the heddle frame stave with a glued-on metal band.

Heddle frame stave 1 illustrated in FIG. 1 comprises light metal hollow profile stave 2 with several channels 3 which extend over its entire length and which are separated from one another by cross ribs 4. Hollow profile stave 2, which in FIG. 1 the front and the rear end are illustrated, can, depending on the size of the heddle frame, be in various different lengths and can reach a length of several meters.

Side walls 5 and 6 of hollow profile stave 2, which are parallel to each other, are each provided with a flat groove-shaped recess or cavity 7, which in the illustrated example is formed continuously, but which can also be discontinuous for a distance before reaching the front or rear end of hollow profile stave 2. Thus, the alternative construction is compatible with the design of the frame stave and the manner of mounting the frame staves onto the lateral supports, forming a heddle frame.

Figure 2:
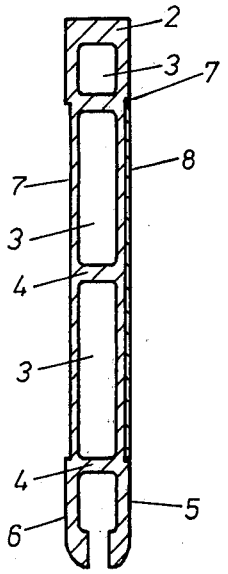
FIG. 2 is a vertical cross-section of the heddle frame stave taken in the direction of line II—II in FIG. 1 and showing a single steel strip glued in place.
Figure 3:
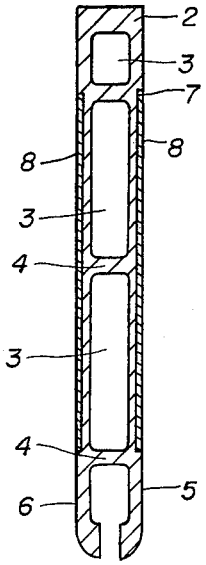
FIG. 3 is a view similar to FIG. 2 and showing steel strips in place on opposite sides of the heddle frame stave.

On at least one side wall 5 of hollow profile stave 2, preferably however on both side walls 5 and 6, there is formed a groove-shaped recess or cavity 7, to which a flat metal strip, preferably steel strip 8, is glued. The width of steel band 8 corresponds in general with the width of groove-shaped cavity 7. The material thickness of steel band 8 and the depth of groove-shaped cavity 7 are adjusted in such a way that the surface of the glued-on steel band 8, which is within groove-shaped cavity 7 on side wall 5 of hollow profile stave 2, is generally flush on all sides with the adjoining regions of the side walls, as shown in FIGS. 2 and 3. In other words, steel band 8 should not protrude laterally over hollow profile stave 2, nor should it be recessed deeper. However, in practice there are, due to manufacturing tolerances, small deviations possible.

FIG. 2 shows steel band 8 glued onto side wall 5 of the hollow profile 2 and therefore makes the groove-shaped cavity 7 on the left-hand side wall 6 clearly recognizable.

FIG. 3 shows steel bands 8 glued onto opposed side walls 5 and 6 within recesses 7 in the same manner as in FIG. 2.

The ratio of dimensions used in the various embodiments compared with the material thickness of the steel band and the wall thickness of the side wall of the hollow profile stave depends on various criteria whereby the total size of the heddle frame, the frequency of lifts in the operation of the weaving machine, as well as further operation conditions have to be considered. It was found that a glued-on steel band with a material thickness of less than half of the wall thickness of the side wall produced good results under most various operative conditions concerning the desired dampening of vibrations. The glued-on steel band covers at least 60% of the side wall of the hollow profile stave. Further, it is also important that an appropriate glue for the connection between the steel band and the hollow profile stave be used. It has been proven that a visco-elastic glue has shown particularly good results. The thickness of the glue layer depends on the material thickness of the steel band. A steel band with a material thickness of 0.2 mm requires for instance a layer thickness of the glue of about 0.05 mm.

What is claimed is:

1. A heddle frame stave, comprising a light metal, longitudinally extending hollow profile stave of closed cross-section having parallel and substantially flat opposed side walls, at least one of said side walls having a predetermined thickness and an outwardly open recess extending between opposite end walls of said stave and being inwardly spaced from opposite longitudinal walls of said stave, a flat, steel, vibration dampening band being attached by means of a layer of visco-elastic glue to said one side wall within said recess, the width of said band, which extends perpendicularly to said longitudinal walls being substantially the same as the width of said recess which likewise extends perpendicularly to said longitudinal walls, said band covering at least about 60% of the surface of said side wall and having a thickness of less than half said predetermined thickness of said one side wall, and the depth of said recess being substantially equal to said band thickness, whereby any vibration of the heddle frame during operation is substantially dampened together with any noise development.

2. The heddle frame stave according to claim 1, wherein each of said walls has a predetermined thickness and an outwardly open recess extending between said end edges and being inwardly spaced from said longitudinal walls, another flat, steel, vibration dampening band being attached by means of a layer of visco-electric glue to the other of said side walls within said recess therein, the width of said another band, which extends perpendicularly to said longitudinal walls, being substantially the same as the width of said recess which likewise extends perpendicularly to said longitudinal walls, said another band having a thickness of less than half each said predetermined thickness, said steel bands respectively covering at least about 60% of the surfaces of said side walls, and the depth of said recess in the other of said side walls being substantially equal to said another band thickness, whereby any vibration of the heddle frame during operation is further dampened together with any noise development.

3. A vibration and noise dampened frame stave for a heddle frame, comprising, a lightweight metal, elongated hollow profile stave of closed cross-section having a central longitudinal axis, said stave comprising parallel and substantially flat o-posed side walls respectively lying on opposite sides of said axis, at least one elongated, flat, steel band being attached by means of a visco-elastic glue to one of said side walls for dampening noise and vibration of the heddle frame, said band extending along said axis and covering a major surface area of said one wall, said one wall being of a predetermined thickness and having an outwardly open recess extending along said axis between opposite end walls of said stave, said recess being defined by opposed edge walls respectively lying remote from said axis and being inwardly spaced from opposite longitudinal side wall edges of said stave, said band being received within said recess and having opposed side edges respectively lying against said opposed edge walls of said recess, said band having a thickness of less than half said predetermined thickness of said one side wall, and the depth of said recess being substantially equal to said band thickness.

4. The frame stave according to claim 3, wherein a pair of elongated, flat, steel bands are respectively attached by means of a visco-elastic glue to said side walls for further dampening noise and vibration of the heddle frame, said bands extending along said axis and each covering a major surface area of each said side wall, the other of said walls being of a predetermined thickness and having an outwardly open recess extending along said axis between said opposite ends walls of said stave, said recess of said other wall being defined by opposed edge walls respectively lying remote from said axis and being inwardly spaced from said longitudinal side wall edges of said stave, said band attached to said other wall being received within said recess thereof and having opposed edge walls respectively lying against said opposed edge walls of said other wall recess, said band attached to said other wall having a thickness of less than half said predetermined thickness of said other wall, and the depth of said other wall recess being substantially equal to the thickness of said band attached to said other wall.

5. The heddle frame stave according to claim 4, wherein said steel bands respectively cover at least 60% of said surface areas of said side walls.

6. The heddle frame stave according to claim 3, wherein said steel band covers at least 60% of said surface area of said side wall.

* * * * *